US007119295B2

(12) United States Patent
Röhr et al.

(10) Patent No.: US 7,119,295 B2
(45) Date of Patent: Oct. 10, 2006

(54) SUSPENDED CONTROL DEVICE

(75) Inventors: Michael Röhr, Dortmund (DE); Anton Münzebrock, Dortmund (DE); Wolfgang Krebs, Wetter (DE); Giuliano Persico, Wetter (DE); Rüdiger Ostholt, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 260 days.

(21) Appl. No.: 10/504,250

(22) PCT Filed: Jun. 30, 2003

(86) PCT No.: PCT/EP03/06924

§ 371 (c)(1),
(2), (4) Date: Aug. 10, 2004

(87) PCT Pub. No.: WO2004/007335

PCT Pub. Date: Jan. 22, 2004

(65) Prior Publication Data

US 2005/0098418 A1 May 12, 2005

(30) Foreign Application Priority Data

Jul. 10, 2002 (DE) ..... 202 11 542

(51) Int. Cl.
*H01H 13/14* (2006.01)

(52) U.S. Cl. ..... 200/298; 200/300; 254/266; 254/361; 198/502.1; 198/570

(58) Field of Classification Search ..... 200/298, 200/300; 198/502.1, 502.4, 570; 254/266–267, 254/275, 329, 361–362
See application file for complete search history.

(56) References Cited

U.S. PATENT DOCUMENTS

| | | | | |
|---|---|---|---|---|
| 5,064,972 | A * | 11/1991 | Munzebrock et al. | 191/30 |
| 5,507,472 | A * | 4/1996 | Bitsch et al. | 254/264 |
| 5,632,469 | A * | 5/1997 | Heun et al. | 254/267 |
| 6,057,521 | A * | 5/2000 | Krebs et al. | 200/298 |
| 6,241,215 | B1 * | 6/2001 | Gersemsky et al. | 254/342 |
| 6,525,282 | B1 * | 2/2003 | Krebs et al. | 200/298 |

* cited by examiner

*Primary Examiner*—K. Lee
(74) *Attorney, Agent, or Firm*—Van Dyke, Gardner, Linn & Burkhart, LLP

(57) ABSTRACT

The invention refers to a hanging control device connected to a unit to be managed, specifically control switches or hanging control panels in order to control hoisting gear, by means of a control line, whereby the control line contains electrical lines (2) to transmit control signals and strain relief, which is supported at the top of the unit to absorb weight and traction forces.

In order to create a hanging control device for which the length of the control line can be easily changed, we suggest that strain relief be created by means of hose (6), which can be folded flat and has the design of a type of textile hose, and that electrical lines (2) run through the inside of the hose.

30 Claims, 3 Drawing Sheets

SUSPENDED CONTROL DEVICE

BACKGROUND OF THE INVENTION

The invention refers to a hanging control device connected to the unit to be managed, specifically control switches or hanging control panels controlling hoisting gear, by means of a control line according to the genus of claim 1.

For example, hanging control devices in the form of hanging control panels are known from EP 0 592 795 A1 and DE-OS 26 03 409, which are used to control the up and down movement of hoisting gear located above an operator. The hanging control panels exhibit housings containing a series of switches. The switch housing's upper end is connected with the hoisting gear via a connecting cable. The connecting cable exhibits a sleeve containing an electrical control line to transmit control signals and strain relief in the form of a steel rope or a metal cable. Strain relief is used to absorb weight and traction forces, and the rope, or cable, is fastened at the top of the hoisting gear. Traction forces are created especially when an operator is pulling transversely on the switch housing in order to move the hoisting gear, which can be moved by means of a carrier. The switch housing may provide a respective handle for this purpose. On the other hand, the sleeve itself may also consist of solid plastic, so that, in addition, the operator may use it as a gripping component.

The disadvantage of known hanging control devices is that their lengths do not extend at all. It is only possible to shorten the cable, which is furthermore complex.

It is often attempted to get by with the chosen length of a connecting cable despite its more complex operability.

SUMMARY OF THE INVENTION

It is the task of the invention to indicate a hanging control device for which the length of a control line can easily be changed.

This task is solved by the characteristics of claim 1. The sub-claims contain advantageous designs of the hanging control device.

The solution provides that strain relief is designed as a hose, which is a type of textile hose and can be folded flat, and that electrical lines run through the inside of the hose. Only the use of such a "textile" hose has made it possible to deposit the part of a control line not needed for a required length in a space-efficient manner and together with electrical lines, without having to forego effective strain relief and a good reach of the control line, specifically when pulling the unit to be controlled.

Depositing the hose folded together with the electrical lines in a repository, i.e. folded along their longitudinal and transverse sizes, results in a low storage volume.

The control line's reach improves, if the hose is filled with elastic material within the operator's realm of reach.

This is easy to do, if the elastic material forms a hollow cylinder, which is slit lengthwise, and through whose hollow space the electrical lines or the cable, if they form such, are run.

Another possible alternative is that the hose runs through a hollow cylinder of elastic material within the operator's realm of reach.

One cost-effective solution provides that the elastic material be made of plastic.

In order to ensure the hose's long durability, we suggest that the hoses support on the unit be accomplished by means of a support device evenly distributing weight and traction forces on the hose's perimeter.

A simple and effective support device can be created using a frustum located on the inside of the hose with an opening for electrical lines and an inner funnel, which is located on the outside of the hose, supported by the unit and which corresponds to the frustum's outer shape, whereby the frustum is pulled into the funnel by means of weight and traction forces, and the hose is thus fixed axially on the unit.

Making the funnel part of the unit is an advantageous alternative.

For an easy assembly, we recommend that the frustum and funnel each be designed slit lengthwise and formed by two halves, which can be stuck together.

In order to be able to disengage the attachment of the hose to the unit, we recommend that the support device exhibit an element with which the frustum can be moved upward from the outside by pressing in on the hose, for which purpose the element is equipped with nibs facing inward and seizing the frustum from below.

For reasons of functionality, the funnel exhibits a longitudinal guide for the element, which can be moved on the outside.

In order to retain the control line not needed, we recommend that a repository for the electrical lines be provided behind the support device, when seen from the hanging control device in the direction of the unit.

BRIEF DESCRIPTION OF THE DRAWINGS

One design example of the invention is shown by means of a drawing as follows. Shown are.

DETAILED DESCRIPTION OF THE PREFERRED EMBODIMENT

Figure 1:
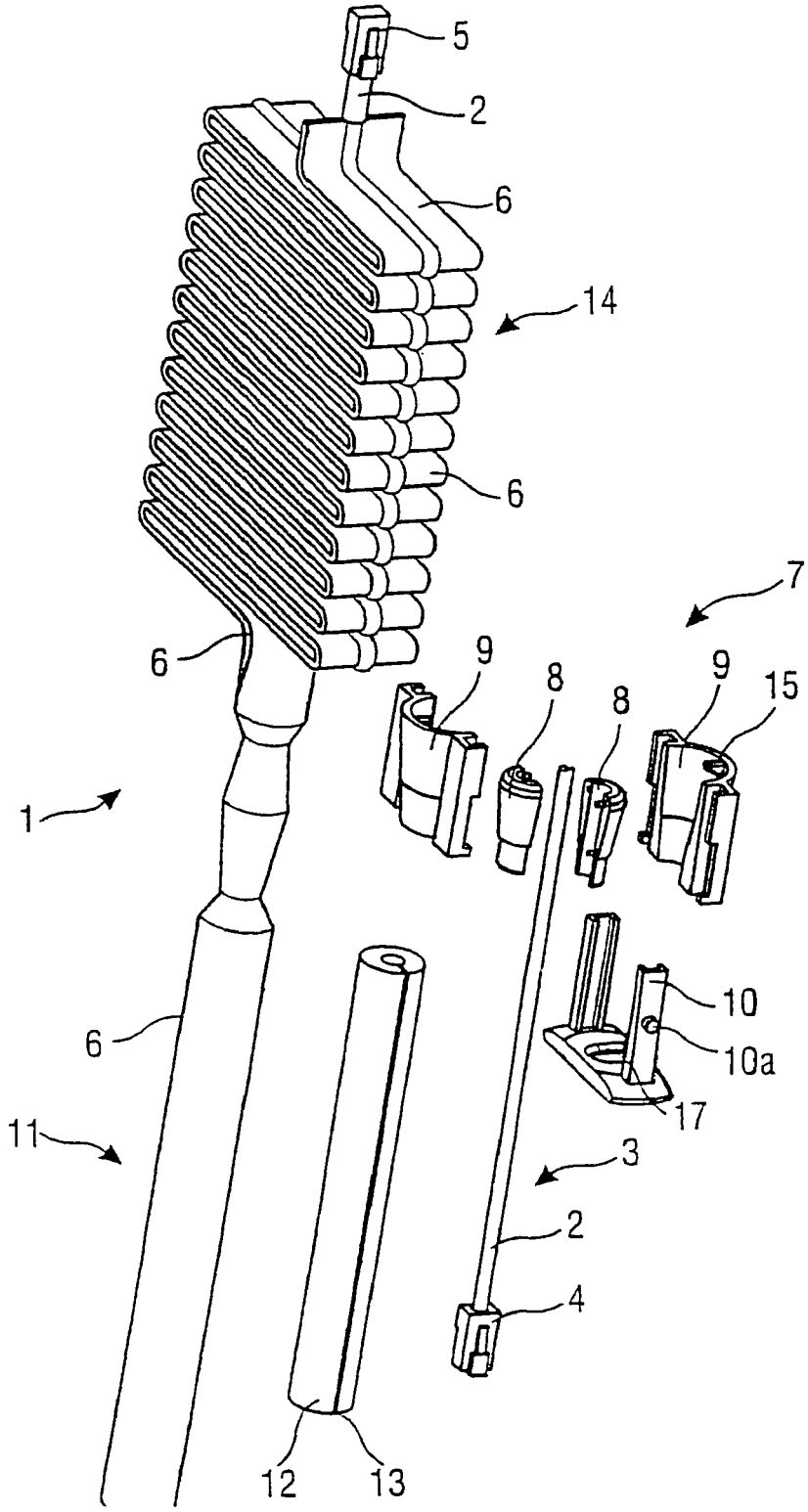
FIG. 1 a control line in a spatial illustration as well as a support device with electrical lines in exploded view, FIG. 2 the control line according to FIG. 1, as a partial section in lateral view, FIG. 3 the front view of a control line according to FIG. 1, and FIG. 4 a control line repository according to FIG. 1 in enlarged view.

FIG. 1 shows transmitter unit 1 of the hanging control device for the control signals of a unit to be managed (neither one is shown), while the hanging control device relative to FIG. 1 is fastened to the bottom of control line 1. The hanging control device may be a control switch with a series of control panels used for the up and down movement of hoisting gear, for example.

Control line 1 exhibits electrical lines 2 in the form of cable 3, at whose ends one electrical connector each 4, 5 are fastened. Electrical lines 2 in the form of cable 3 are used to transmit control signals from the hanging control device to the unit to be managed, in this case, therefore, the hoisting gear. FIG. 1 only shows the lower part of cable 3 with electrical lines 2. Aside from cable 3, control line 1 also possesses strain relief in the form of flatly folded hose 6, that is a type of textile hose. Hose 6 may consist of woven or braided textile like a textile hose. The textile material may be plastic as well as natural textile matter. The outer diameter of cable 3 is correlated to the inner diameter of hose 6 at a minimum ratio of 1:3, in this case 1:5. Hose 6 is supported at the top of the unit via support device 7, which is created by frustum 8 and corresponding (inner) funnel 9, while frustum 8 is located on the inside of hose 6. By means of element 10, frustum 8 may be moved slightly upward from the outside in relation to fastened funnel 9, in order to disengage the connection between hose 6 and the unit. Hollow cylinder 12, consisting of rigid elastic material and thus forming a solid handle while protecting electrical lines 2, is located within an operator's realm of reach 11 and inside of hose 6; the rigid elastic material may also extend beyond the entire lower length of the hose. Electrical lines 2 run through its opening, while longitudinal slit 13 facilitates an effortless introduction of electrical lines 2, respectively cable 3, into the hollow cylinder. Hose 6 is filled with elastic material within an operator's realm of reach 11.

The elastic material is elastic foam with a respective rigidity.

The entire strain relief to absorb occurring weight and traction forces is accomplished via hose 6 alone.

However, as an alternative, hose 6 with cable 3 running through its inside may also pass through a hollow cylinder of elastic material, which may therefore also encase hose 6 on its outside.

Figure 2:
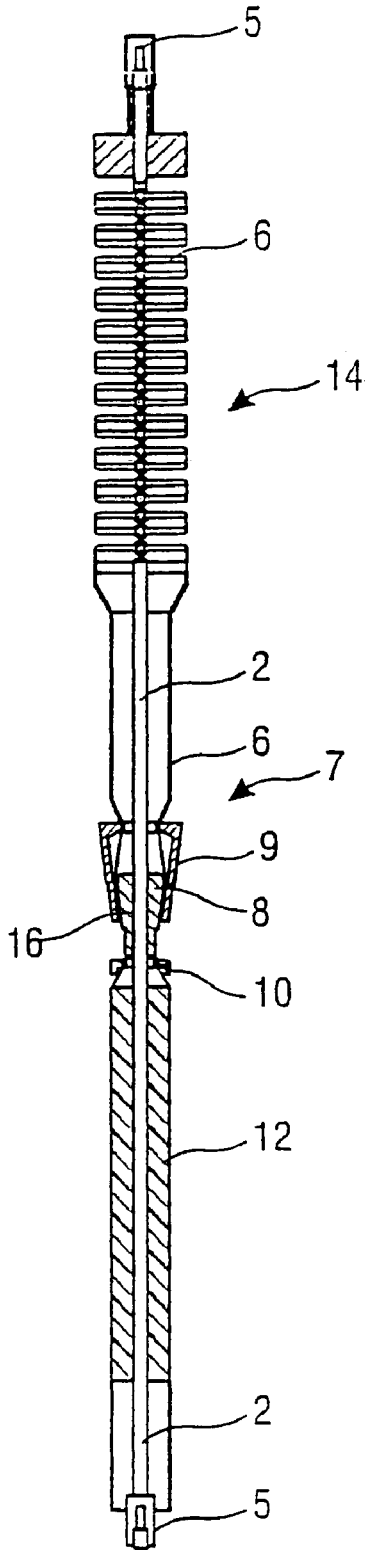
Figure 3:
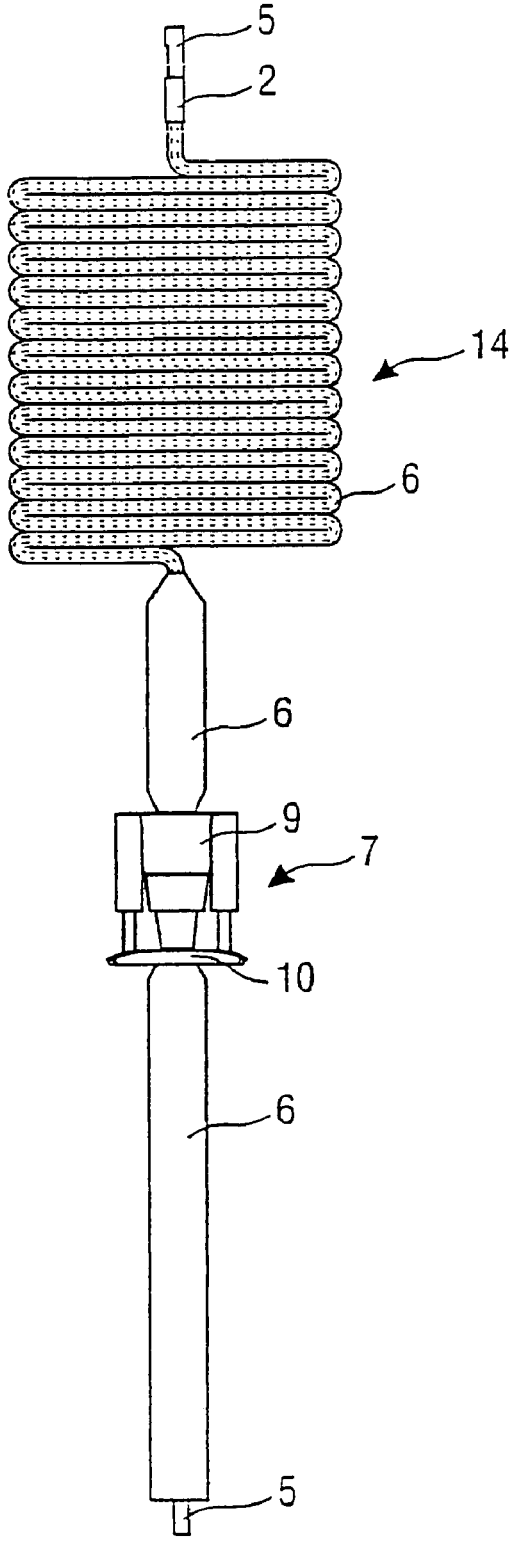

FIG. 2 shows a sectional lateral view of control line 1; FIG. 3 shows its corresponding front view. Specifically FIG. 2 points out cable 3 running from bottom to top with lines 2, which are placed flat and their upper ranges folded together with the surrounding hose, thus forming cable repository 14.

Further, FIG. 2 shows support device 7 in operation, as weight and traction forces are distributed evenly on the hose perimeter. Frustum 8, formed by its two halves, is located inside hose 6. Its travel downward is limited by funnel 9 and upward by nib 15 (see FIG. 1) on funnel 9. As shown in FIG. 1, element 10 in funnel 15 is guided by means of pilot 10*a*. Funnel 9 is firmly supported by the unit, that is the hoisting gear, so that as traction forces occur, frustum 8 is pulled down, whereby the hose is again fixed axially relative to funnel 9. Of course the frustum's shape must correspond to the inner funnel of funnel 9. This way, weight and traction forces are distributed evenly on the hose perimeter.

Frustum 8 is equipped with opening 16, through which cable 3 with electrical lines 2 is run in a loose manner. If element 10 is moved upward, it will take along frustum 8 through hose 6, so that the connection between frustum 8 and funnel 9 is disengaged again. It is subsequently possible to drop hose 6 with cable 3 from repository 14 from above and pull it downward through support device 7 after frustum 8 has been moved upward, whereby a simple extension of control cable 1 is made possible.

Conversely, control cable 1 may also be shortened in this manner.

Figure 4:
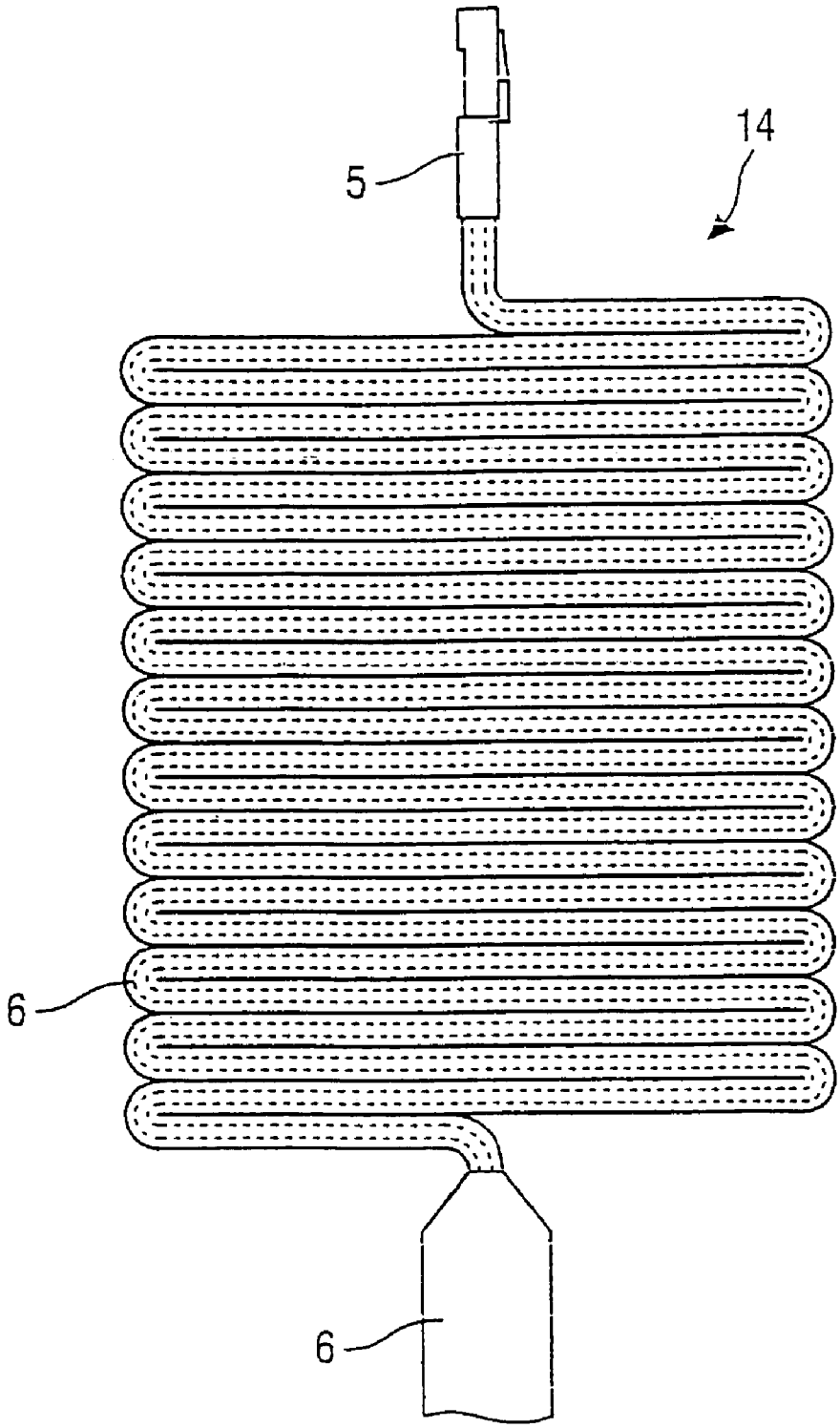

FIG. 4 again shows repository 14 in enlarged view.

The invention claimed is:

1. A hanging control device connected to a unit to be managed, comprising:

a hanging control panel having control switches to control hoisting gear, said control panel supported by a control line;

said control line containing electrical lines to transmit control signals and a strain relief, said strain relief supported at the top of the unit to absorb weight and traction forces;

wherein said strain relief is created by a hose that is configured to be folded flat and is a textile hose, wherein said electrical lines run through said inside of the hose.

2. A hanging control device according to claim 1, wherein said hose together with said electrical lines can be folded and placed in a repository.

3. A hanging control device according to claim 2, wherein said hose is filled with elastic material within an operator's reach.

4. A hanging control device according to claim 3, wherein said elastic material forms a hollow cylinder, said cylinder being slit lengthwise and through whose hollow space run said electrical lines forming said cable.

5. A hanging control device according to claim 4, wherein said elastic material is made of foam.

6. A hanging control device according to claim 3, wherein said elastic material is made of foam.

7. A hanging control device according to claim 1, wherein said hose runs through a hollow cylinder made of elastic material within an operator's reach.

8. A hanging control device according to claim 7, wherein said elastic material is made of foam.

9. A hanging control device according to claim 8, wherein said hose is supported from the unit by means of a support device that evenly distributes weight and traction forces on the perimeter of said hose.

10. A hanging control device according to claim 9, wherein said support device is created by a frustum located inside said hose and with an opening for said electrical lines and a funnel located outside of said hose and supported by the unit, said funnel having a configuration substantially corresponding to a configuration of said frustum, whereby said frustum is pulled into said funnel by means of weight and traction forces and thus affixes said hose axially on the unit.

11. A hanging control device according to claim 10, wherein said funnel is part of the unit.

12. A hanging control device according to claim 11, wherein said frustum and said funnel are each slit lengthwise and formed by two halves that can be joined together.

13. A hanging control device according to claim 12, wherein said support device exhibits an element with which said frustum can be moved upward from the outside in order to remove the axial attachment of said hose from the unit, for which said element includes inward facing nibs that seize said frustum.

14. A hanging control device according to claim 13, wherein said movable element runs lengthwise through said funnel.

15. A hanging control device according to claim 14, including a repository is for said electrical lines behind said support device, when seen from the hanging control device in direction to the unit.

16. A hanging control device according to claim 9, wherein said support device exhibits an element with which said frustum can be moved upward from the outside in order to remove the axial attachment of said hose from the unit, for which said element includes inward facing nibs that seize said frustum.

17. A hanging control device according to claim 9 including a repository for said electrical lines behind said support device when seen from the hanging control device in direction to the unit.

18. A hanging control device according to claim 10, wherein said frustum and said funnel are each slit lengthwise and formed by two halves that can be joined together.

19. A hanging control device according to claim 10, wherein said support device exhibits an element with which said frustum can be moved upward from the outside in order to remove the axial attachment of said hose from the unit, for which said element includes inward facing nibs that seize said frustum.

20. A hanging control device according to claim 10 including a repository for said electrical lines behind said support device when seen from the hanging control device in direction to the unit.

21. A hanging control device according to claim 11, wherein said support device exhibits an element with which said frustum can be moved upward from the outside in order to remove the axial attachment of said hose from the unit, for which said element includes inward facing nibs that seize said frustum.

22. A hanging control device according to claim 11 including a repository for said electrical lines behind said support device when seen from the hanging control device in direction to the unit.

23. A hanging control device according to claim 12 including a repository for said electrical lines behind said support device when seen from the hanging control device in direction to the unit.

24. A hanging control device according to claim 13 including a repository for said electrical lines behind said support device when seen from the hanging control device in direction to the unit.

25. A hanging control device according to claim 1, wherein said hose is filled with elastic material within an operator's reach.

26. A hanging control device according to claim 25, wherein said elastic material forms a hollow cylinder, said cylinder being slit lengthwise and through whose hollow space run said electrical lines forming said cable.

27. A hanging control device according to claim 1, wherein said strain relief is created by a textile hose that is configured to be folded flat, wherein said electrical lines run through an inside of said hose.

28. A hanging control device according to claim 27, wherein said support device is created by a frustum located inside said hose and with an opening for said electrical lines and a funnel located outside of said hose and supported by the unit, said funnel has a configuration substantially corresponding to a configuration of said frustum, whereby said frustum is pulled into said funnel by means of weight and traction forces and thus affixes said hose axially on the unit.

29. A hanging control device according to claim 28, wherein said funnel is part of the unit.

30. A hanging control device according to claim 29, wherein said frustum and said funnel are each slit lengthwise and formed by two halves that can be joined together.

* * * * *

UNITED STATES PATENT AND TRADEMARK OFFICE

CERTIFICATE OF CORRECTION

PATENT NO. : 7,119,295 B2
APPLICATION NO. : 10/504250
DATED : October 10, 2006
INVENTOR(S) : Michael Röhr et al.

It is certified that error appears in the above-identified patent and that said Letters Patent is hereby corrected as shown below:

Column 1:
Line 67, "hoses" should be --hose's--.

Column 4:
Line 45, Claim 15, Delete "," after "14".
Line 46, Claim 15, Delete "is" after "repository".
Line 47, Claim 15, Delete "," after "device".

Signed and Sealed this

Sixth Day of February, 2007

JON W. DUDAS
*Director of the United States Patent and Trademark Office*